US007992336B2

(12) United States Patent
Phillips

(10) Patent No.: US 7,992,336 B2
(45) Date of Patent: Aug. 9, 2011

(54) GUNSTOCK

(76) Inventor: David Anthony Phillips, Canton, TX (US)

( * ) Notice: Subject to any disclaimer, the term of this patent is extended or adjusted under 35 U.S.C. 154(b) by 253 days.

(21) Appl. No.: 12/222,314

(22) Filed: Aug. 7, 2008

(65) Prior Publication Data

US 2011/0138670 A1 Jun. 16, 2011

Related U.S. Application Data

(63) Continuation of application No. 11/048,934, filed on Feb. 3, 2005, now abandoned.

(51) Int. Cl.
*F41C 23/00* (2006.01)

(52) U.S. Cl. ..... 42/72; 42/71.01

(58) Field of Classification Search ..... 42/72, 71.01
See application file for complete search history.

(56) References Cited

U.S. PATENT DOCUMENTS

| | | | | | |
|---|---|---|---|---|---|
| 305,537 | A * | 9/1884 | Schwatka | 42/72 |
| 1,195,055 | A * | 8/1916 | McNeal | 89/37.04 |
| 1,269,178 | A * | 6/1918 | Hamilton | 356/254 |
| 1,300,688 | A * | 4/1919 | Bellard | 42/118 |
| 2,139,691 | A * | 12/1938 | Michal, Jr | 89/140 |
| 2,145,078 | A * | 1/1939 | Ferrel | 42/72 |
| 3,618,584 | A * | 11/1971 | Pigeon | 124/19 |
| 5,813,157 | A * | 9/1998 | Scott et al. | 42/71.01 |
| 6,367,187 | B2 * | 4/2002 | Bubits | 42/72 |
| 6,637,142 | B1 * | 10/2003 | Reynolds | 42/75.03 |
| 7,200,966 | B2 * | 4/2007 | Gooder | 42/71.01 |

* cited by examiner

*Primary Examiner* — Michelle Clement
(74) *Attorney, Agent, or Firm* — Stephen R. Greiner

(57) ABSTRACT

A gunstock including a barrel brace and a pistol grip projecting downwardly from the rear of the barrel brace. An X-shaped crosspiece projects rearwardly from the pistol grip. A butt projects rearwardly from the crosspiece. A handle projects forwardly from the bottom of the pistol grip.

5 Claims, 3 Drawing Sheets

10
B
26
35
L1
14
D5
70
66
68
D4
C
A
L2
62
12
64
D1
D2
D3

126
110
114
125
124
112
142
148
150
120
154
164
144
118
162
116
136
170
130
155
156

210
214
224
212
242
248
250
220
254
244
218
262
216
236
225
255
256
230
270
264

GUNSTOCK

CONTINUING APPLICATION DATA

This application is a continuation of U.S. patent application Ser. No. 11/048,934, filed on Feb. 3, 2005, now abandoned.

FIELD OF THE INVENTION

The present invention relates generally to firearms and, more particularly, to stocks for firearms.

BACKGROUND OF THE INVENTION

Typical firearms have a number of drawbacks that make aiming and firing more difficult than necessary. For example, firearm users must contort their bodies while shooting by raising their elbows away from their trunks to elevate their firearms and by lowering their heads to sight their firearms. Also, since most firearms are constructed from relatively heavy components to protect users from explosive discharges, holding elevated firearms steady, especially for prolonged periods, is burdensome for some. Finally, since no provision is made in conventional firearms for rapidly raising them from resting positions to firing positions, many shots are often missed—a serious burden for hunters.

SUMMARY OF THE INVENTION

In light of the problems associated with known firearms, it is a principal object of the invention to provide an improved gunstock that is easy for a user to hold in an elevated, shooting position for prolonged periods. The gunstock maintains the head of the user in a near vertical orientation and urges the elbows of the user toward his trunk for optimal sighting. With the elbows "in," even users with minimal muscle strength can hold firearms, equipped with the inventive gunstock, steady.

It is another object of the invention to provide a gunstock of the type described that can be adapted for use in long- and short-barreled firearms of many kinds: rifles, shotguns, muskets, air guns, and pistols, to name a few. The gunstock can also be incorporated into a variety of makes and models of firearms of small and large caliber.

It is an additional advantage of the invention to provide a gunstock that, when incorporated into an air gun with a spring-type charging mechanism, permits a user to attain more leverage upon the cocking lever than has heretofore been possible. With more leverage, charging mechanisms having greater power than has heretofore been practical can be incorporated into air guns. The result is air guns that will fire projectiles at higher velocities and with greater effective ranges.

It is a further object of the invention to provide a gunstock of the type described that can be incorporated into newly constructed firearms or retrofit into existing firearms. In either case, installation is easy to accomplish with neither specialized tools nor prolonged training being required to accomplish the task.

Still another object of the invention is to provide a gunstock of the type described that permits a user to easily carry an equipped firearm at his side and, in one sweeping motion, to single-handedly elevate the firearm to his shoulder for firing. The firing process requires only a few seconds to complete and can provide an opportunity to make a shot that would otherwise be too late. This is, of course, a great advantage for hunters.

It is an object of the invention to provide improved features and arrangements thereof in a gunstock for the purposes described that is lightweight in construction, inexpensive to manufacture, and fully dependable in use.

Briefly, the gunstock in accordance with this invention achieves the intended objects by featuring a barrel brace for supporting a gun barrel. A pistol grip projects downwardly from the barrel brace. An X-shaped crosspiece projects rearwardly from the pistol grip. A butt projects rearwardly from the crosspiece. A trigger guard connects the pistol grip and the barrel brace. A handle connects the bottom of the pistol grip and the front of the barrel brace. A pistol grip guard connects the trigger guard and the handle.

The foregoing and other objects, features and advantages of the present invention will become readily apparent upon further review of the following detailed description of the preferred embodiments as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
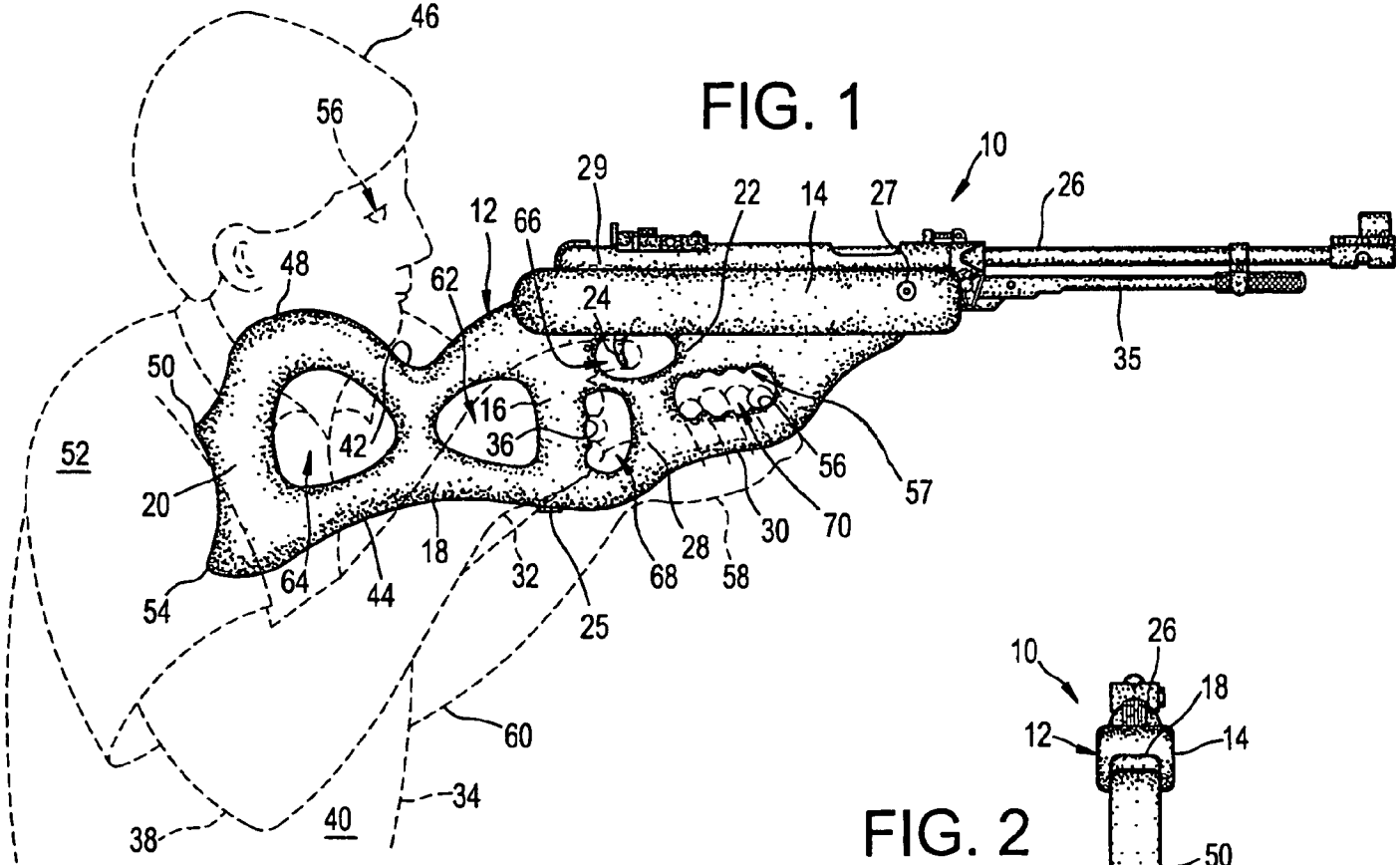
FIG. 1 is a side view of a firearm equipped with a preferred embodiment of a gunstock in accordance with the present invention held by a standing user for firing.
Figure 2:
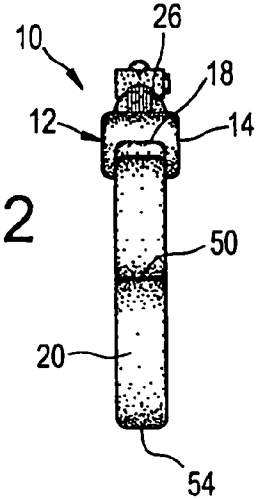
FIG. 2 is a rear view of the firearm of FIG. 1.

Referring now to FIGS. 1-5, a firearm 10, being a spring-type air rifle with a gunstock 12 in accordance with the present invention, is shown. Gunstock 12 includes a barrel brace 14 from the rear of which a pistol grip 16 projects downwardly. An X-shaped crosspiece 18 projects rearwardly from pistol grip 16 and connects such to a butt 20. A handle 30 projects forwardly and upwardly from the bottom of pistol grip 16 to the front of brace 14. A trigger guard 22 projects forwardly and upwardly from the middle of pistol grip 16 and connects to the bottom of brace 14 in front of a trigger 24 extending downwardly from barrel 26 through brace 14. A pistol grip guard 28 projects forwardly and upwardly from handle 30 and connects to the bottom of trigger guard 22 beneath trigger 24. Gunstock 12 is formed as a unitary whole from metal, plastic, wood, or other suitable material.

Brace 14 supports the rearward portion of firearm barrel 26 and a spring-type charging mechanism 29 that is energized by rotating an associated cocking lever 35. Brace 14 has a U-shaped cross section so as to receive barrel 26 and components of mechanism 29 in its top. The longitudinal axes of brace 14 and barrel 26 are substantially parallel to a sight line $L_1$ passing through reference points A and B. For strength, brace 14 is provided with a width that is about twice that provided to the features defining the balance of gunstock 12.

Figures 5, 6, 7:
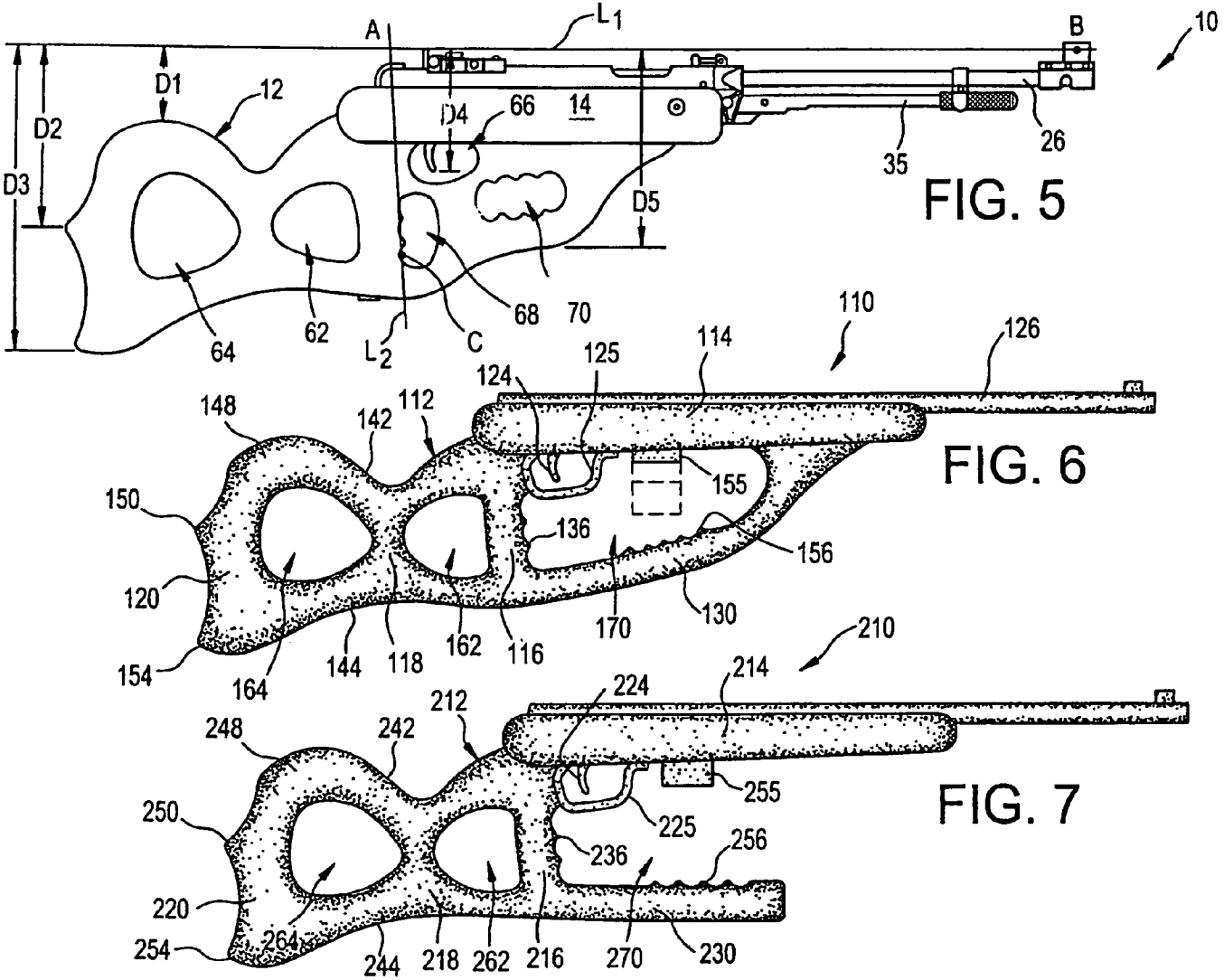
FIG. 5 is a diagrammatic view showing the firearm of FIG. 1 and some dimensional relationships found in its features.
FIG. 6 is a side view of a firearm equipped with a second embodiment of a gunstock in accordance with the present invention.
FIG. 7 is a side view of a firearm equipped with a third embodiment of a gunstock in accordance with the present invention.

Pistol grip 16 is dimensioned for easy grasping by the firing hand 32 of a user 34. The front of pistol grip 16 is provided with a number of projections 36 below trigger 24 that retain the middle, ring and little fingers in place and ensure that the index/trigger finger of hand 32 contacts the bottom of trigger 24 for a steady pull. As shown in FIG. 5, the front of pistol grip 16 falls along a line $L_2$ passing through points A and C that is inclined about 85 degrees from sight line $L_1$. This inclination imparts a downward rotation to hand 32 that urges the elbow 38 inwardly against the user's trunk 40 for improved bracing of firearm 10.

Threaded fasteners 25 and 27 secure gunstock 12 to mechanism 29 and barrel 26 in a conventional manner. Fastener 25 extends upwardly through pistol grip 16 into mechanism 29. Paired fasteners 27 pass laterally through opposite sides of the front of brace 14 and into mechanism 29.

Crosspiece 18 is provided with a recess 42 in its top and a recess 44 in its bottom. Recess 42 is deep and receives portions of the user's head 46 for unimpeded sighting of firearm 10. Recess 44, however, is shallow and can be comfortably positioned upon the hip of user 34 for shooting or resting.

The top portion of crosspiece 18 that is separated from brace 14 by recess 42 defines a comb 48 upon which the cheek of user 34 can be lightly rested during sighting. Comb 48 has a large drop D1 of about 2.5 inches (6.3 cm) from the sight line, resulting in a comb 48 that is low. With a typical stock, a low comb can cause shooting under a target. Similarly, a high comb on a typical stock forces a user to look down upon a barrel resulting in shots over a target. The unique configuration of butt 20, however, renders the problems with the combs of known firearm stocks moot.

Butt 20 has a heel 50 for engagement with the top of shoulder 52 of user 34 and a toe 54 for engagement with the bottom of shoulder 52. As shown, heel 50 and toe 54 are provided with large drops D2 and D3 of about 6 inches (15 cm) and about 10.5 inches (26 cm), respectively. With the bottom of trigger 24 having a drop D4 of only 4.5 inches (11 cm), it will be appreciated that barrel 26 is elevated substantially above the level provided by an ordinary gunstock so as to offer perfect alignment of the sighting eye 56 of user 34 whose head 46 is held substantially vertical. Also, the drops D2 and D3 given to heel 50 and toe 54 lower elbow 38 onto trunk 40 for a very steady hold on firearm 10 while aiming and firing to ensure maximum accuracy of a shot.

Trigger guard 22 serves to protect trigger 24 from accidental blows that might discharge firearm. The rear end of guard 22 is connected to the top of pistol grip 16. The front end of trigger guard 22 is connected to the midpoint of brace 14.

Pistol grip guard 28 protects the fingers of hand 32 from blows that could cause firearm 10 to be dropped. The bottom end of guard 28 is connected to handle 30. The top end of guard 28, however, is connected to trigger guard 22.

Handle 30 is used to carry and position firearm 10. The rear end of handle 30 is connected to the bottom of pistol grip 16 and the front end of handle 30 is connected to the front end of barrel brace 14. Along a portion of its length, handle 30 is provided with a series of upward projections 56 that serve to separate the fingers of the user's bracing hand 58 for comfort and stability in shooting and carrying firearm 10. Above projections 56, the front of trigger guard 22 is provided with a series of downward projections 57 that permit stock 12 to be grasped in a variety of ways by hand 58.

Handle 30 takes the place of the foregrip of conventional gunstocks and is used to carry and position firearm 10. Handle 30 has a drop D5 of about 7 inches (18 cm) and is substantially lower than the foregrip of conventional firearms. When hand 58 grasps handle 30 as shown in FIG. 1 to aim firearm 10, associated elbow 60 is pressed into trunk 40 for optimum bracing of firearm 10.

From the foregoing, it will be appreciated that the structure of gunstock 12 establishes a number of voids or openings passing laterally through gunstock 12. For example, a thumbhole 62 is formed between the rear of pistol grip 16 and the front of crosspiece 18. Also, a shoulder hole 64 exists between the rear of crosspiece 18 and the front of butt 20. Likewise, a trigger opening 66 is formed between brace 14, pistol grip 16 and trigger guard 22. Further, a grip opening 68 is formed between pistol grip 16, trigger guard 22 and pistol grip guard 28. Finally, handle opening 70 is formed between trigger guard 22, pistol grip guard 28 and handle 30.

The voids or openings in gunstock 12 serve a variety of purposes. Thumbhole 62 accommodates the thumb of firing hand 32 and is lower than trigger 24 to urge the wrist of hand 32 downwardly to press elbow 38 toward body trunk 40. Shoulder hole 64, however, lightens gunstock 12 considerably. Trigger opening 66 and grip opening 68, of course, accommodate the trigger 24 forming part of mechanism 29 of firearm 10 as well as the fingers of firing hand 32 that are required to hold firearm 10 and squeeze trigger 24 to discharge firearm 10. Handle opening 70 permits bracing hand 58 to firmly grasp gunstock 12.

The use of gunstock 12 to carry firearm 10 is straightforward. To do this, bracing hand 58 need merely grasp handle 30 by inserting the fingers thereof into handle opening 70. Next, by inverting firearm 10, such can be toted for extended periods in the manner of a suitcase. Since handle 30 is located near the balance point of firearm 10, firearm 10 is easily transported in a position that is horizontal to the ground to avoid snagging on brush, etc.

From the carrying position, firearm 10 can be raised to shoulder 52 for firing in one continuous motion without changing the grip of hand 58 upon handle 30. Here, hand 58, with its thumb pointing forward, need only be brought across trunk 40 to an elevated position that places butt 20 against shoulder 52. Simultaneously, firing hand 32 is brought into firing position with its thumb being placed in thumbhole 62, index finger on trigger 24 and remaining fingers in pistol grip opening 68. Thus, firearm 10 can be made ready for discharge in a matter of seconds.

Figure 3:
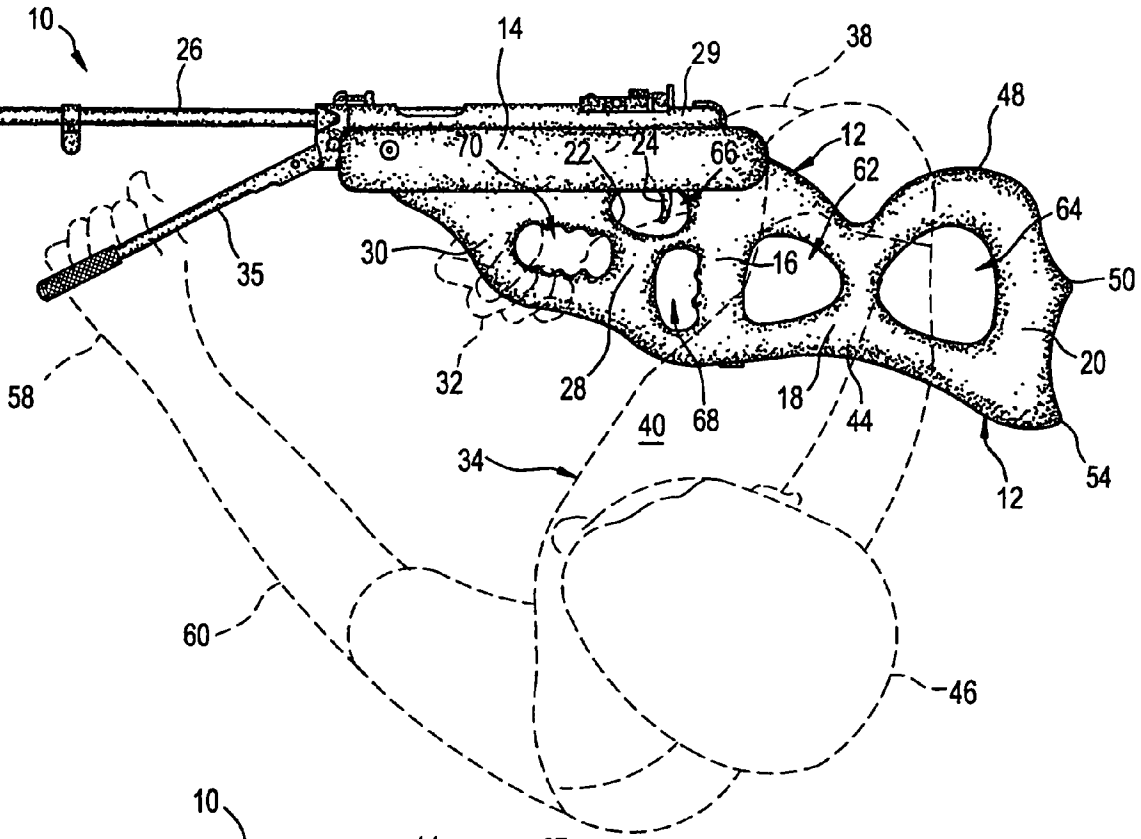
FIG. 3 is a view from above of a user, with the firearm of FIG. 1 on his hip, drawing back the cocking lever of the firearm.
Figure 4:
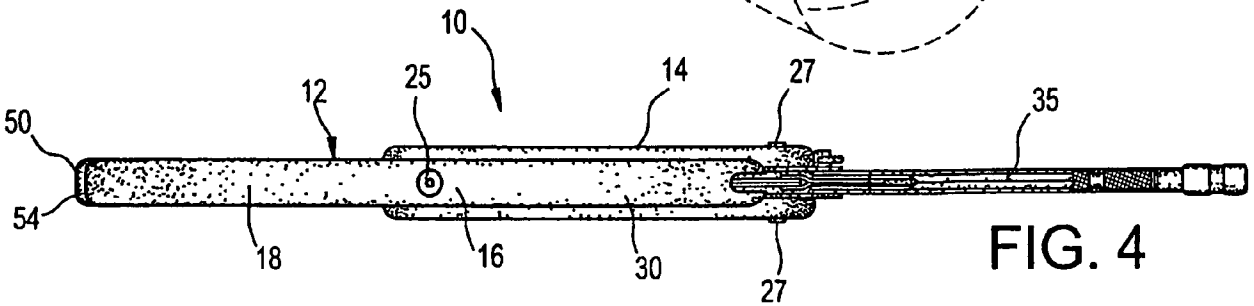
FIG. 4 is a bottom view of the firearm of FIG. 1.

To charge mechanism 29 so that a projectile can be propelled from barrel 26 of firearm 10, handle 30 is first grasped by hand 32 as shown in FIG. 3. Then, with gunstock 12 cradled in the arm of user 34 that terminates at hand 32, firearm 10 is lowered to the hip of user 34. The hip is next positioned within recess 44 of crosspiece 18. Finally, lever 35 is grasped by hand 58 and pumped once by pivoting lever 35 first toward trunk 40 and, then, returning lever 35 to its original position. Firearm 10 is now ready to fire. The entire charging process requires but a few seconds to complete and is accomplished in complete comfort with user being capable of imparting substantial force upon lever 35.

It should be noted that the gunstocks of conventional firearms having spring-type charging mechanisms sometimes split across their pistol grips. The forces generated by the pivoting of a cocking lever are sometimes greater than the cross-grained wood typically found in a pistol grip can withstand, resulting in failure. To overcome the problem, most air rifles have enlarged pistol grips for added strength that, unfortunately, are more difficult and less comfortable to grasp. Gunstock 10, however, evenly distributes charging forces through handle 30, pistol grip 16, crosspiece 18 and butt 20. Thus, gunstock 12 can withstand much more stress than conventional gunstocks.

Referring now to FIG. 6, a rifle or firearm 110 having a second gunstock 112 in accordance with the present invention is shown. Gunstock 112 is substantially similar to gunstock 12, but does not include an integral trigger guard and pistol grip guard in order to accommodate a bullet-containing clip 155. As such, description of the features common to firearm 10 and firearm 110 will not be belabored. Nonetheless, the differences will be specified in detail below.

Gunstock 112 includes a barrel brace 114 from the rear of which a pistol grip 116 projects downwardly. An X-shaped crosspiece 118 projects rearwardly from pistol grip 116 and connects to a butt 120. A handle 130 projects forwardly and upwardly from the bottom of pistol grip 116 and connects to the front of brace 114.

Brace 114 supports the rearward half of firearm barrel 126. Brace 114 has a U-shaped cross section so as to receive barrel 126 and components of a rifle firing mechanism, including trigger 124 and integral trigger guard 125, in its top. Brace 114 has a width that is about twice that as the balance of gunstock 112.

Pistol grip 116 is made for easy grasping. In this regard, pistol grip 116 has a length sufficient to extend across the palm of the hand of a user. Additionally, the front of pistol grip 116 is provided with a number of projections 136 below trigger 124 that retain the fingers of a user.

Crosspiece 118 is provided with a recess 142 in its top and a recess 144 in its bottom. Recess 142 is relatively deep and recess 144 is shallow. The top portion of crosspiece 118 separated from brace 114 by recess 142 defines a comb 148. Butt 120 has a heel 150 and a toe 154.

Trigger guard 125, being integrally formed with the firing mechanism of firearm 110, forms no part of gunstock 112. Trigger guard 125 serves to protect trigger 124 from accidental blows. The rear end of trigger guard 125 abuts the top of pistol grip 116.

Handle 130 is used to carry and position firearm 110. The rear end of handle 130 is connected to pistol grip 116 and the front end of handle 130 is connected to the front end of barrel brace 114. Along a portion of its length, handle 130 is provided with a series of upward projections 156 that serve to separate the fingers of the user's bracing hand. Above projections 156, the bullet clip 155 is releasably engaged with firearm 110 in a conventional manner.

Gunstock 112 has a number of voids or openings. First, a thumbhole 162 is formed between pistol grip 116 and crosspiece 118. Also, a shoulder hole 164 exists between crosspiece 118 and butt 120. Finally, a handle opening 170 is formed between brace 114, pistol grip 116, and handle 130. Handle opening 170 is sufficiently large to permit clip 155 to be engaged to, and disengaged from, firearm 110. Of course, it would occur to one of ordinary skill in the art that opening 170 could be employed with equal advantage with firearms having rotary magazines and firearms of drop door-type that are loaded from the top and unloaded from the bottom.

The height of handle opening 170 can be varied to suit the needs of a user. For example, a 3-inch (7.6 cm) height is appropriate for firearms equipped with conventional clips like the one shown at 155 and rotary block magazines. A 4-inch (10 cm) height is suitable for firearms with extended clips. Finally, a 4.5-inch (11 cm) height is ideal for the extra-long clips and drop magazines.

In FIG. 7 is shown a firearm 210 having a third gunstock 212 in accordance with the present invention. Gunstock 212 is a modified form of gunstock 112, but, as can be clearly seen, its handle 230 does not connect to the front of barrel brace 214. Under some conditions of use, firearm 210 can be easier to carry and fire than firearms 10 and 110.

Gunstock 212 includes a barrel brace 214 from the rear of which a pistol grip 216 projects downwardly. Pistol grip 216 is provided with a number of projections 236 below trigger 224 that retain the fingers of a user. Beneath projections 236, handle 230 extends forwardly from the bottom of pistol grip 216 and terminates at a point below brace 214. Along a portion of its length, handle 230 is provided with a series of upward projections 256 that separate the fingers of the user's bracing hand. An X-shaped crosspiece 218 projects rearwardly from pistol grip 216 and connects such to a butt 220. Crosspiece 218 is provided with a recess 242 in its top and a recess 244 in its bottom. The top portion of crosspiece 218 separated from brace 214 by recess 242 defines a comb 248. Butt 220 has a heel 250 and a toe 254.

Trigger guard 225, being integrally formed with the firing mechanism of firearm 210, forms no part of gunstock 212. Trigger guard 225 serves to protect trigger 224 from accidental blows. The rear end of trigger guard 225 abuts the top of pistol grip 216. Forward of trigger guard 225, a bullet clip 255 is releasably engaged with firearm 210 in a conventional manner.

Gunstock 212 has a number of voids or openings. First, a thumbhole 262 is positioned between pistol grip 216 and the center of crosspiece 218. Also, a shoulder hole 264 is bracketed between crosspiece 218 and butt 220. Additionally, a handle opening 270 is formed between brace 214, pistol grip 216, and handle 230. Handle opening 270 is open at its front end and is large enough to permit clip 255 to be easily engaged with, and disengaged from, firearm 210.

While the invention has been described with a high degree of particularity, it will be appreciated by those skilled in the art that modifications may be made thereto. Therefore, it is to be understood that the present invention is not limited to the several embodiments described above, but encompasses any and all embodiments within the scope of the following claims.

I claim:

1. A unitary gunstock for a firearm having a long barrel, a sight line positioned above the barrel, and a trigger being positioned below the barrel, said gunstock comprising:

an elongated, barrel brace having a first top, a first bottom, a first front and a first rear; and said brace being adapted to receive the barrel in said first top thereof and the trigger in said first rear thereof;

a pistol grip having a second top, a second bottom, a second front and a second rear; said pistol grip being connected at said second top thereof to said first rear of said barrel brace adjacent to the trigger; and said pistol grip projecting downwardly and forwardly from said first rear of said barrel brace;

an X-shaped crosspiece having a third top, a third bottom, a third front and a third rear; said crosspiece being connected at said third front thereof to said second rear of said pistol grip; and said crosspiece projecting rearwardly from said pistol grip;

a butt having a fourth top, a fourth bottom, a fourth front and a fourth rear; said butt being connected at said fourth front thereof to said third rear of said crosspiece; and said butt projecting rearwardly from said crosspiece; and, a handle having a fifth top, a fifth bottom, a fifth front and a fifth rear; said handle being connected at said fifth rear thereof to said second bottom of said pistol grip and being connected at said fifth front thereof to said first front of said barrel brace; and said handle projecting forwardly from said second bottom of said pistol grip; and said handle projecting rearwardly from said first front of said barrel brace; wherein the barrel brace, the pistol grip, the X-shaped crosspiece, the butt and the handle are formed as a unitary piece.

2. The gunstock according to claim 1 further comprising a trigger guard having a sixth top, a sixth bottom, a sixth front and a sixth rear; said trigger guard being connected at said sixth rear thereof to said second top of said pistol grip and being connected at said sixth front thereof to said barrel brace between said first front and said first rear; and said trigger guard projecting forwardly from said pistol grip.

3. The gunstock according to claim 2 further comprising a pistol grip guard having a seventh top, a seventh bottom, a seventh front and a seventh rear; said pistol grip guard being connected at said seventh top thereof to said trigger guard between said sixth front and said sixth rear; said pistol grip guard also being connected at said seventh bottom thereof to said handle between said fifth front and said fifth rear; and said pistol grip guard projecting downwardly from said trigger guard and projecting upwardly from said handle.

4. The gunstock according to claim 1 wherein said third top of said crosspiece defines a comb for engagement with a cheek of a user and said fourth rear of said butt defines a heel for engagement with a shoulder of a user; said heel and said comb are positioned below the sight line; and said heel is located about 2.4 times farther away from said sight line than said comb.

5. The gunstock according to claim 1 wherein said pistol grip and said handle are each provided with a plurality of spaced apart projections for separating the fingers of a user.

* * * * *